US005690157A

United States Patent [19]

Chen

[11] Patent Number: 5,690,157

[45] Date of Patent: Nov. 25, 1997

[54] RIGID PANEL FOLDING SHOWER DOOR ASSEMBLY HAVING IMPROVED HORIZONTAL TRACK AND METHOD FOR MAKING THE SAME

[76] Inventor: Chang-Than Chen, 181 Po-Hai Street, Kaohsiong, Taiwan

[21] Appl. No.: 595,893

[22] Filed: Feb. 6, 1996

Related U.S. Application Data

[63] Continuation-in-part of Ser. No. 247,365, May 23, 1994, abandoned, and a continuation-in-part of Ser. No. 380,547, Jan. 30, 1995, abandoned.

[51] Int. Cl.[6] ..... E05D 15/26

[52] U.S. Cl. ..... 160/199; 160/DIG. 6; 160/206; 4/558; 4/608; 248/251; 16/95 R; 16/87.4 R

[58] Field of Search ..... 160/199, 330, 160/DIG. 6, 206; 248/251, 264; 4/607, 608, 557, 558; 16/94 R, 95 R, 87.6 R, 87.4 R, 87.8, 93 R

[56] References Cited

U.S. PATENT DOCUMENTS

| | | | |
|---|---|---|---|
| 712,163 | 10/1902 | White | 16/87.6 R |
| 1,023,963 | 4/1912 | Ramming | 16/87.6 R |
| 1,032,265 | 7/1912 | Anerson | 16/87.4 R |
| 1,700,184 | 1/1929 | Sipes | 160/199 |
| 2,320,308 | 5/1943 | Silveman | 16/87.4 R |
| 2,674,432 | 4/1954 | Lorentzen | 248/264 |
| 2,761,150 | 9/1956 | Kellogg . | |
| 3,062,279 | 11/1962 | Kochanowski | 160/199 X |
| 3,418,666 | 12/1968 | Rockey . | |
| 3,766,597 | 10/1973 | Ford er al. | 16/87.4 R |
| 3,799,237 | 3/1974 | Proserpi . | |
| 5,301,735 | 4/1994 | Chen . | |
| 5,421,059 | 6/1995 | Leffers, Jr. | 16/87.4 R |

FOREIGN PATENT DOCUMENTS

| | | | |
|---|---|---|---|
| 382391 | 11/1964 | Switzerland | 16/87.4 R |
| 29555 | 6/1913 | United Kingdom | 248/264 |

*Primary Examiner*—Blair Johnson
*Attorney, Agent, or Firm*—Charles E. Baxley, Esq.

[57] ABSTRACT

A improved folding shower door assembly and related method of manufacture therefor are disclosed in which rigid panels with living hinges therebetween are supported by a horizontal track, with the shower door assembly mating at both sides thereof by removably inserting plastic closure channels at the sides of the shower door into retaining members mounted on opposing walls. The shower door assembly consists essentially of a plurality of semi-rigid panels which may be molded together in a single molding operation or by assembling panels together, with living hinges being located intermediate each adjacent pair of semi-rigid panels. A bathtub trim member located on top of the outer lip of the bathtub functions to retain the bottom edge of the shower door assembly, thereby preventing it from moving out over the edge of the bathtub and retaining water within the bathtub. The horizontal track uses a plastic rail located within a metal track member from which the shower door is suspended, with the plastic rail functioning to allow the shower door to open and close smoothly and with a minimum of noise.

1 Claim, 5 Drawing Sheets

RIGID PANEL FOLDING SHOWER DOOR ASSEMBLY HAVING IMPROVED HORIZONTAL TRACK AND METHOD FOR MAKING THE SAME

IDENTIFICATION OF RELATED APPLICATION

This application is a continuation-in-part of U.S. patent application Ser. No. 08/247,365, abandoned, filed on May 23, 1994, and entitled "Rigid Panel Folding Shower Door Assembly Having Mating Support and Closure Members and Method for Making the Same," and a continuation-in-part of U.S. patent application Ser. No. 08/380,547, abandoned, filed on Jan. 30, 1995, and also entitled "Rigid Panel Folding Shower Door Assembly Having Mating Support and Closure Members and Method for Making the Same."

BACKGROUND OF THE INVENTION

Field of the Invention

The present invention relates generally to the field of shower doors, and more particularly to an improved folding shower door assembly and related method of manufacture in which rigid panels with living hinges therebetween which are supported by an improved two piece horizontal track, with the shower door assembly mating at its sides with retaining members mounted on opposing walls, with both sides mating removably with plastic closure channels.

It is quite common for bathrooms to have bathtubs which are located in a recessed manner such that the bathtub is accessible from a single side only. Such bathtubs can easily be converted into a shower by adding either a shower curtain or a sliding glass door assembly to prevent water from a shower fixture from escaping from the area located immediately above the bathtub. Shower curtains are generally made of either plastic or cloth, and hang from a horizontal rod with their lower edge located inside the bathtub. Sliding glass doors are typically made of safety glass, and slide within tracks mounted below the sliding glass doors on the lip of the bathtub, and above the sliding glass doors under a horizontal member located some distance above the lip of the bathtub. Both shower curtains and sliding glass doors are widely accepted and used, although neither curtains nor sliding glass doors are without their respective drawbacks.

Shower curtains have one principal advantage over sliding glass doors, and that is their low cost. Single sheet shower curtains require only a single panel of plastic or cloth, which is typically suspended from a horizontal shower rod located above the lip of the bathtub. The lower edge of such a shower curtain is disposed within the inside of the bathtub adjacent the outer lip of the bathtub when the shower curtain is in use, to thereby keep shower water within the bathtub area.

Double curtains add a second curtain which hangs adjacent the fist curtain, with the second curtain's lower edge falling outside the outer lip of the bathtub. The second curtain functions for a strictly cosmetic purpose to improve the physical appearance of the shower curtain assembly.

While shower curtains are certainly relatively inexpensive when compared and contrasted with sliding glass doors, they are limited in their other advantages. Shower curtains take up approximately a quarter of the distance between the tub end walls even when fully opened, and are generally not removed since their removal is inconvenient due to the large number of hooks required to support them. They are difficult to clean because of their flexible nature, and often tend to appear as something short of neat and tidy.

Functionally, shower curtains also leave something to be desired from a functional standpoint. By their nature, shower curtains are retained only at their top edge, and therefore water can easily escape between their side edges and the wall, particularly at the end nearest the shower nozzle. Shower curtains typically do not move as smoothly or easily as sliding glass doors, and are much more noisy than sliding glass doors as they are moved to open or close the tub enclosure. In addition, when warm or hot water is being used to shower, the air flow within the tub area tends to cause the shower curtain to move inwardly against the body of the person showering, which is annoying at best. Accordingly, shower curtains are typically used despite their disadvantages only because of their low cost.

Sliding glass doors are generally used in upscale installations because they do not have many of the disadvantages inherent in shower curtains. Such sliding glass doors are typically double doors made of metal-framed safety glass. One sliding glass door overlaps the other to retain water inside the tub area. A frame is used around all four sides of sliding glass door assemblies, with the side frames fitting around the edges of the sliding glass doors abutting the walls in a manner retaining most of the shower water within the tub area.

Sliding glass doors have several of their own disadvantages, however. First, they are quite expensive to purchase, particularly when compared to shower curtains. Secondly, they cover slightly more than half of the tub area even when opened, which can result in a closed-up look and feel to the bathroom, particularly when the sliding glass doors are made using translucent or opaque glass. In addition, if they are bumped during showering and opened even a crack, they can allow large amounts of water to leak out of the shower and onto the bathroom floor.

It is accordingly the primary objective of the present invention that it provide an improved shower door assembly combining the best features of both shower curtains and sliding glass doors, while not presenting any of the relative disadvantages of either shower curtains or sliding glass doors. As such, it is an objective that the improved shower door assembly of the present invention present the operational advantage of sliding glass doors in that the shower door be relatively rigid when in use to form a fixed, water-containing enclosure not subject to movement due to air flow caused by the warm or hot stream of shower water. It is a further objective of the present invention that it also present the advantageous sealing aspect of sliding glass doors at both ends thereof, and that this sealing aspect be enhanced by a positive closing mechanism on both ends of the shower door.

It is another objective of the improved shower door assembly of the present invention that it slide smoothly and easily, and that it be relatively quiet as it is opened or closed. It is an additional objective of the improved shower door assembly of the present invention that it be storable in a compact and unobtrusive package when not in use to present an aesthetically pleasing appearance when so stored. It is a related objective that the improved shower door of the present invention be both easy and convenient to open and close. It is a further objective that the improved shower door of the present invention be relatively easy to install, without requiring specialized tools or a high degree of mechanical ability to install it.

The improved shower door of the present invention must also be of construction which is durable, long lasting, and easy to keep clean, and it should require no maintenance by the user during its operating lifetime. In order to enhance the market appeal of the improved shower door of the present invention, it should also be of inexpensive construction as compared to a sliding glass door, to thereby afford it the broadest possible market. Finally, it is also an objective that all of the aforesaid advantages and objectives of the improved shower door of the present invention be achieved without incurring any substantial relative disadvantage.

SUMMARY OF THE INVENTION

The disadvantages and limitations of the background art discussed above are overcome by the present invention. With this invention, a shower door assembly is made of a plurality of rigid plastic panels having living hinges installed therebetween, with the shower door being suspended from a horizontal track. The shower door assembly is secured at both sides when in use, with both sides of the shower door assembly being removably securable to vertical closure channels secured to the opposing walls on the sides of the bathtub enclosure.

The horizontal track is the only major component of the improved shower door of the present invention which is not entirely made of plastic. In the preferred embodiment, the horizontal track includes a metal track member, with a plastic rail being located inside the metal track member. The metal track member is preferably made of aluminum, and is essentially cylindrical in configuration, with a longitudinally extending slot being located therein. A plastic track rail also having a longitudinal slot located therein is located within the metal track member, and the hardware used to suspend the shower door assembly from the horizontal track will glide smoothly and quietly within the plastic rail. The horizontal track is supported at the ends thereof by support members which may be either screwed into the walls or adhesively secured in place using silicone adhesive.

Both sides of the shower door assembly are removably fixable to closure channels which are adhesively secured to the wall at the opposing ends of the bathtub using silicone adhesive. The mechanism used to secure both ends of the shower door assembly to the closure channel is an interference fit between the edge of the shower door assembly and the closure channel. When so fixed in the closure channel, the shower door assembly is quite waterproof.

Located on top of the outer lip of the bathtub under the bottom edge of the shower door assembly is a bathtub trim member which prevents the bottom edge of the shower door assembly from moving beyond the outer edge of the lip of the bathtub. While the bottom edge of the shower door assembly abuts this bathtub trim member, it is not retrained therein, but rather is merely prevented from moving outwardly to a point where shower water could escape from the shower door assembly. The bathtub trim member is also adhesively secured to the edge of the bathtub, preferably through the use of silicone adhesive.

In operation, the folding shower door assembly of the present invention is normally folded into a compact configuration adjacent one or the other of the opposing walls on which the closure channels are mounted when the shower door is not in use. To use the folding shower door, it is unfolded by pulling it closed, and placing leader channel members located at both ends thereof into their interference fits in the closure channels on the opposing walls in a sealing manner.

It may therefore be seen that the present invention teaches an improved shower door assembly combining the best features of both shower curtains and sliding glass doors, while not presenting any of the relative disadvantages of either shower curtains or sliding glass doors. As such, the improved shower door assembly of the present invention presents the operational advantage of sliding glass doors in that it is relatively rigid when in use, forming a fixed water-containing enclosure which is not subject to movement due to air flow caused by the warm or hot stream of shower water. The improved shower door assembly of the present invention also presents the advantageous sealing aspect of sliding glass doors at both ends thereof, and in fact further enhances this sealing aspect through the use of a positive closing mechanism on both ends of the shower door.

The improved shower door assembly of the present invention slides smoothly and easily due to the improved design of the track member, and it is relatively quiet as it is opened or closed. The improved shower door assembly of the present invention is storable in a compact and unobtrusive folded package when not in use, and thus presents an aesthetically pleasing appearance when so stored. In addition, the improved shower door of the present invention is both easy and convenient to open and close, and in one embodiment may even be opened at either end thereof. Further, the improved shower door of the present invention is relatively easy to install, and its installation does not require specialized tools or a high degree of mechanical ability.

The improved shower door of the present invention is of a construction which is durable, long lasting, and easy to keep clean, and it requires no maintenance from the user during its operating lifetime. The improved shower door of the present invention is also of inexpensive construction as compared to a sliding glass door, thereby enhancing its market appeal and affording it the broadest possible market. Finally, all of the aforesaid advantages and objectives of the improved shower door of the present invention are achieved without incurring any substantial relative disadvantage.

DESCRIPTION OF THE DRAWINGS

These and other advantages of the present invention are best understood with reference to the drawings, in which.

DETAILED DESCRIPTION OF THE PREFERRED EMBODIMENT

The preferred embodiment of the present invention discloses a shower door assembly of novel configuration, which, with the exception of a single metal segment used as an element of the track member to suspend the shower door assembly, may be made predominantly from extruded plastic materials. Prior to a description of the shower door assembly itself, a discussion will first be presented describing the various mounting components used to suspend and seal the shower door assembly.

Figure 1:
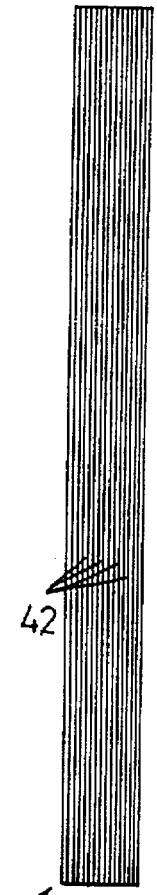
FIG. 1 is a back side plan view of a closure channel for installation in a vertical configuration above the outer lip of a bathtub (not shown in FIG. 1) and at one end thereof in a sealing manner adjacent the wall at the one end of the bathtub, showing a plurality of grooves located in the bottom surface thereof.
Figure 2:
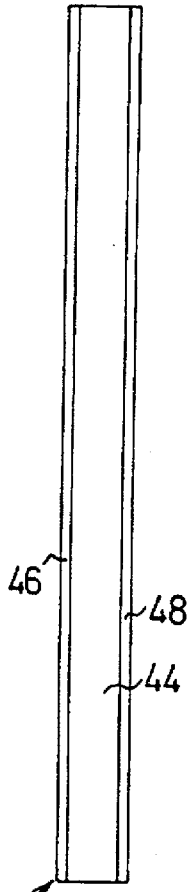
FIG. 2 is a plan view of the closure channel illustrated in FIG. 1 from the side which will face the wall at the other end of the bathtub, showing the longitudinal slot located in the closure channel.
Figure 3:
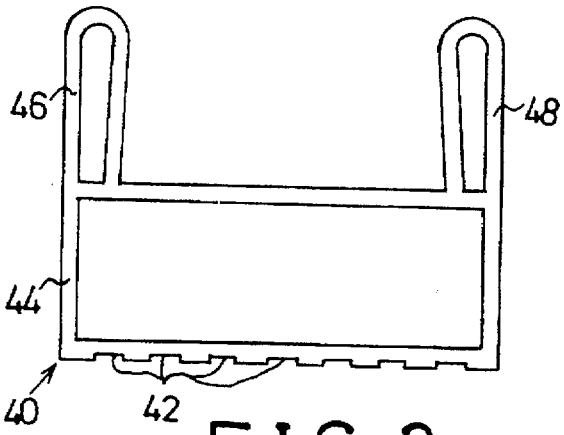
FIG. 3 is an end view of the closure channel illustrated in FIGS. 1 and 2, showing the cross-sectional configuration of the closure channel.

Referring first to FIGS. 1 through 3, a closure channel 40 made of extruded plastic material is illustrated. As will become evident below in conjunction with the discussion of FIG. 21, two of the closure channels 40 will be installed in a vertical configuration at opposing side walls in an opening located above the outer lip of a bathtub (not shown in FIGS. 1 through 3). As best shown in FIGS. 1 and 3, the back side of the closure channel 40 has a plurality of shallow longitudinal grooves 42 which run the length of the closure channel 40. The longitudinal grooves 42 increase the effective surface area of the back side of the closure channel 40. Silicone adhesive (which will be used to secure the closure channel 40 to a wall) can fit into the longitudinal grooves 42, aiding adhesion onto the wall.

Referring specifically to FIG. 3, the cross section of the closure channel 40 may be described as consisting of a hollow rectangular segment 44 which has two thin hollow legs 46 and 48 extending from the sides thereof. The hollow legs 46 and 48 together with the hollow rectangular segment 44 form an essentially U-shaped configuration, with the hollow rectangular segment 44 forming the base of the U and the hollow legs 46 and 48 forming the legs of the U. The hollow legs 46 and 48 are separated by a gap which defines a longitudinal slot in the closure channel 40.

Note that the thicknesses of the hollow legs 46 and 48 are greater at the ends thereof furthest away from the hollow rectangular segment 44. Thus, the longitudinal slot defined between the hollow legs 46 and 48 is widest near the hollow rectangular segment 44, and narrowest near the ends of the hollow legs 46 and 48. In addition, note that the distal ends of the hollow legs 46 and 48 (the ends furthest from their point of connection to the hollow rectangular segment 44) are rounded to serve as a guide into the longitudinal slot. As mentioned above, in the preferred embodiment, the closure channel 40 is made of extruded plastic, with its configuration giving it a strong, yet lightweight construction.

Figure 6:
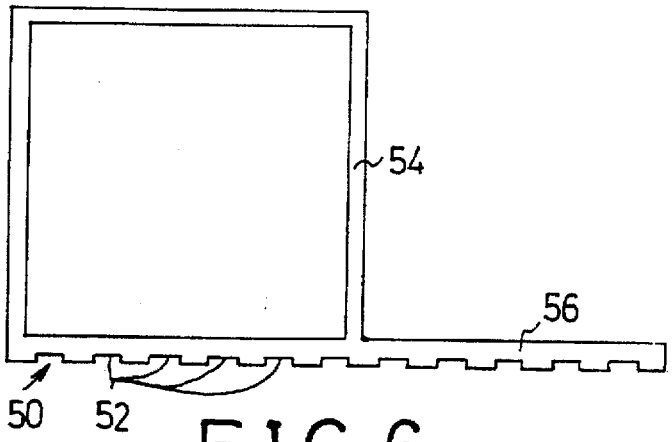
FIG. 6 is an end view of the bathtub trim member illustrated in FIGS. 4 and 5, showing its cross-sectional configuration.
Figure 4:
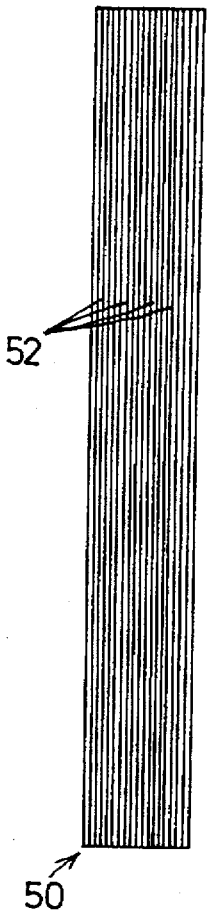
FIG. 4 is a bottom plan view of a bathtub trim member for installation onto the top of the outer lip of a bathtub (not shown in FIG. 7) to retain the bottom edge of the shower door assembly (not shown in FIG. 7) inside the outer perimeter of the bathtub, showing a plurality of grooves located in the bottom surface thereof.
Figure 5:
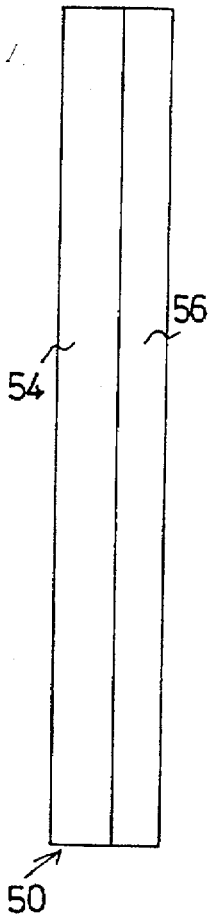
FIG. 5 is a top plan view of the bathtub trim member illustrated in FIG. 4.

Referring next to FIGS. 4 through 6, a bathtub trim member 50 also made of extruded plastic material is illustrated. As will become evident below in conjunction with the discussion of FIG. 21, the bathtub trim member 50 will be installed in a horizontal manner onto the top of the outer lip of a bathtub (not shown in FIGS. 4 through 6) between the bottom ends of the closure channels 40 (FIGS. 1 through 3) mounted on opposing side walls. As best shown in FIGS. 4 and 6, the back side of the bathtub trim member 50 has a plurality of shallow longitudinal grooves 52 which run the length of the bathtub trim member 50. The longitudinal grooves 52 increase the effective surface area of the back side of the bathtub trim member 50. Silicone adhesive (which will be used to secure the bathtub trim member 50 to the outer lip of a bathtub) can fit into the longitudinal grooves 52, aiding adhesion onto the bathtub.

Referring specifically to FIG. 6, the cross section of the bathtub trim member 50 consists in part of a hollow square segment 54 having a higher height at one side thereof and a lower height at the other side thereof. Extending from the side of the hollow square segment 54 is a thin flat strip 56 which, together with the bottom of the hollow square segment 54, forms the flat bottom surface of the bathtub trim member 50 which has the longitudinal grooves 52 disposed therein. As mentioned above, in the preferred embodiment, the bathtub trim member 50 is made of extruded plastic, with its configuration giving it a strong, yet lightweight construction.

Figure 7:
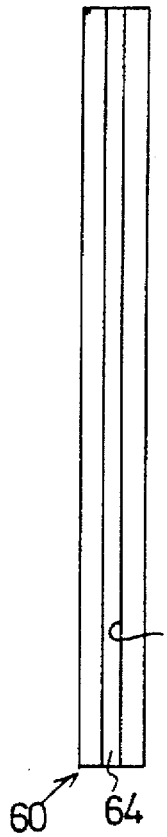
FIG. 7 is a bottom side view of a metal track member for use in supporting the shower door assembly (not shown in FIG. 9) therefrom.
Figure 8:
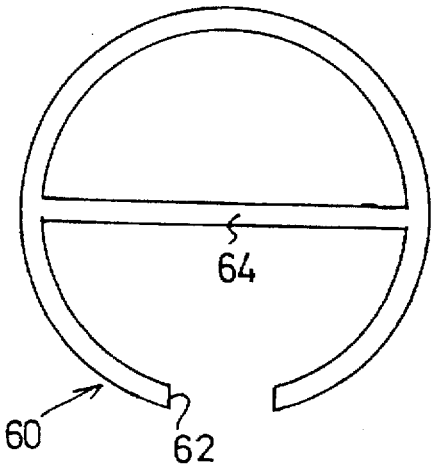
FIG. 8 is an end view of the metal track member illustrated in FIG. 7, showing its cross-sectional configuration and particularly showing a horizontal web extending within the metal track member.

Referring next to FIGS. 7 and 8, a metal track member 60 for use in supporting the shower door (not shown in FIGS. 7 and 8) is illustrated. The metal track member 60 is preferably made of aluminum, and is the only major component of the present invention that is made of metal rather than plastic. As will become evident below in conjunction with the discussion of FIG. 21, the metal track member 60 will be installed in a horizontal configuration at or near the top of an opening located above the outer lip of a bathtub (not shown in FIGS. 7 and 8).

The outer side of the metal track member 60 is essentially annular in cross section, as best shown in FIG. 8. The metal track member 60 has a longitudinally extending slot 62 located in the bottom thereof. Located inside the metal track member 60 is a thin, horizontal rib member 64, which is located above and is spaced away from the longitudinally extending slot 62, forming a diameter of the metal track member 60.

Figure 21:
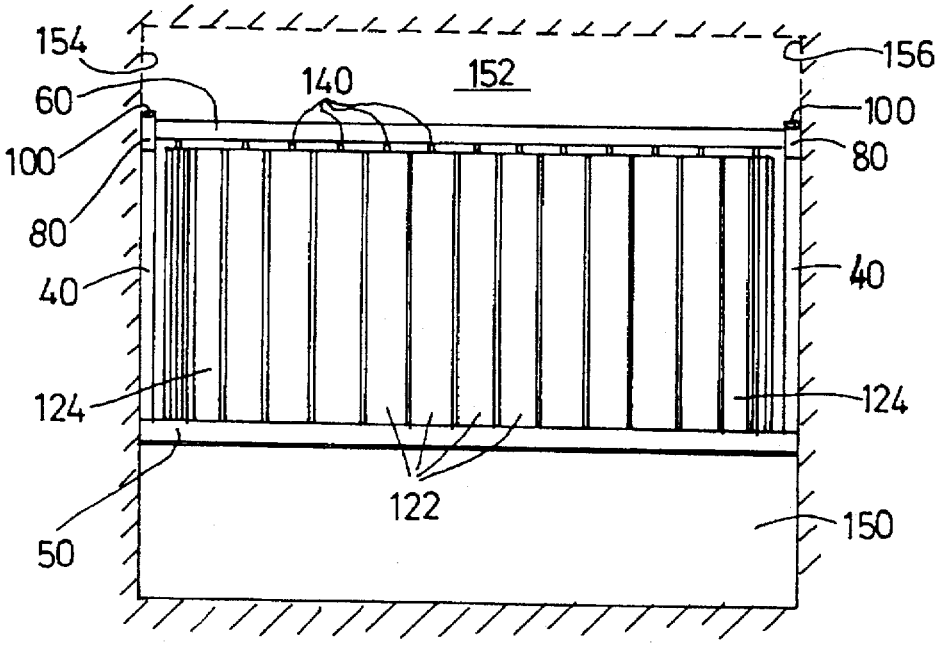
FIG. 21 is a front view of a bathtub located in a recessed area, with one of the closure channels illustrated in FIGS. 1 through 3 installed on the opposing walls at the left and right ends of the bathtub, and with the shower door assembly illustrated in FIG. 19 installed from the metal track member illustrated in FIGS. 7 and 8.

The metal track member 60 will be used to suspend the shower door of the present invention (not shown in FIGS. 7 and 8) in an embodiment illustrated in FIG. 21. The horizontal rib member 64 functions to reinforce the metal track member 60, and to enhance the ability of the metal track member 60 to support the weight of the shower door therefrom.

Figure 9:
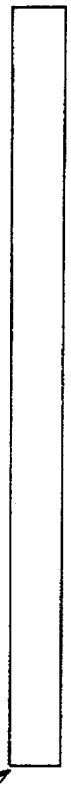
FIG. 9 is a top side view of a plastic rail which will be installed within the metal track member illustrated in FIGS. 7 and 8.
Figure 10:
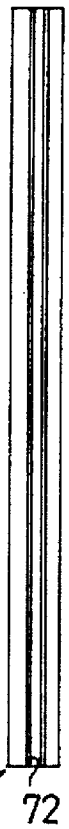
FIG. 10 is a bottom side view of the plastic rail illustrated in FIG. 9, showing a slot located in the bottom side thereof.
Figure 11:
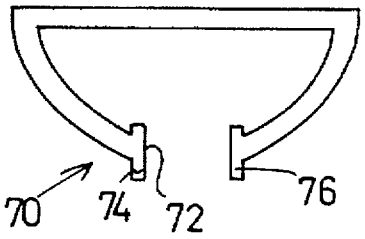
FIG. 11 is an end view of the plastic rail illustrated in FIGS. 9 and 10, showing its cross-sectional configuration.

Referring next to FIGS. 9 through 11, a plastic rail 70 which will be installed within the metal track member illustrated in FIGS. 7 and 8 is shown. The plastic rail 70 is designed to fit as an insert within the metal track member 60 below the horizontal rib member 64 (as shown in FIG. 8). The outer side of the plastic rail 70 is thus essentially semi-circular in cross section, as best illustrated in FIG. 11, with the interior of the plastic rail 70 being hollow. The top side of the plastic rail 70, shown in FIGS. 9 and 11, is flat to fit underneath the horizontal rib member 64 in the metal track member 60 (shown in FIG. 8).

The plastic rail 70 has a longitudinally extending slot 72 located in the bottom thereof. Located on opposite sides of the longitudinally extending slot 72 are thin, flat segments 74 and 76, which each extend both slightly below and slightly above the semi-circular portions of the plastic rail 70. The flat segments 74 and 76 are parallel to each other, and are orthogonally oriented with respect to the flat top side of the plastic rail 70.

The flat segments 74 and 76 extend sufficiently below the semi-circular portions of the plastic rail 70 to fill the longitudinally extending slot 62 in the metal track member 60 (shown in FIG. 8). The plastic rail 70 is sized to fit snugly within the metal track member 60, forming the bearing surfaces into which supporting hardware will be installed to support the shower door (not shown in FIGS. 9 through 11) therefrom. In the preferred embodiment, the plastic rail 70 is made of extruded durable, low friction plastic, with its configuration giving it a strong, yet lightweight construction.

Figure 13:
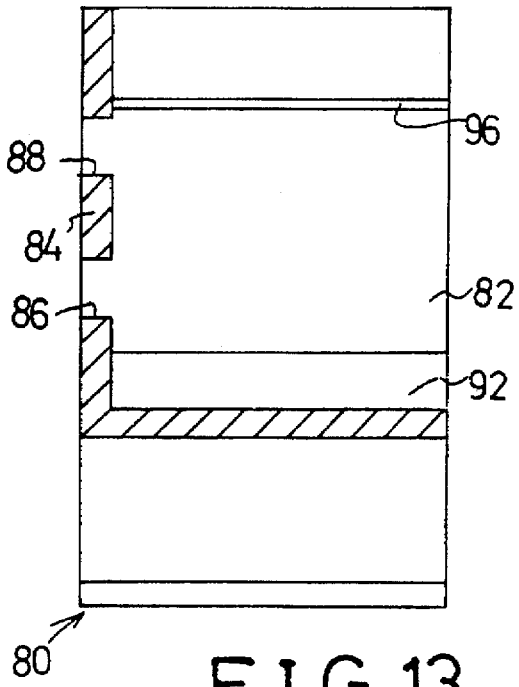
FIG. 13 is a cross-sectional view of the support member illustrated in FIG. 12, showing in plan view one of the flat segments and one of the retaining bars.
Figure 12:
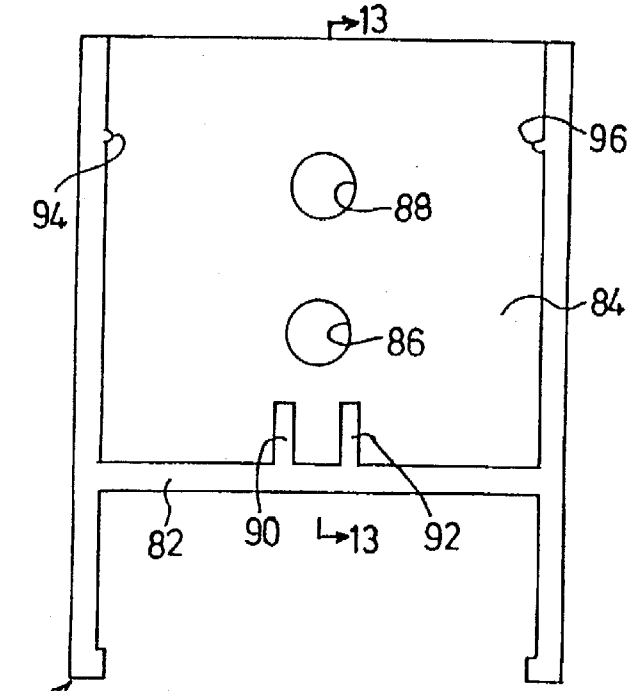
FIG. 12 is a plan view of a support member used at each end of the metal track member illustrated in FIGS. 7 and 8, showing its configuration from the side into which an end of the metal track member will fit, and particularly showing two flat segments extending upwardly from the bottom of the cross member of the support member, and retaining bars extending from opposing interior surfaces of the support member.

Referring now to FIGS. 12 and 13, a support member 80 made of molded plastic material is illustrated. As will become evident below in conjunction with the discussion of FIG. 21, one support member 80 will be used to support each end of the metal track member 60 (shown in FIGS. 7 and 8). Referring for the moment specifically to FIG. 12, the support member 80 may be described as consisting primarily of a segment 82 which is essentially H-shaped in cross section. The portions of the legs of the H above the crossbar are longer than are the portions of the legs of the H below the crossbar.

Referring again to FIGS. 12 and 13, at one end of the H-shaped segment 82 is a plate segment 84 which extends above the cross-bar of the H and between the portions of the legs of the H which are above the cross-bar of the H. A spaced-apart pair of mounting apertures 86 and 88 are located in the plate segment 84 midway between the legs of the H. Extending upwardly from the cross-bar of the H near the center thereof are two thin, flat segments 90 and 92.

Located on the support member 80 inside the portions of the legs of the H between which the plate segment 84 extends are two small retaining bars 94 and 96. The retaining bars 94 and 96 extend inwardly from opposing interior surfaces of the legs of the H, and are located slightly below the top of the support member 80. The retaining bars 94 and 96 will be used to retain a cap (not shown in FIGS. 12 and 13) on top of the support member 80 once the metal track member 60 (shown in FIG. 8) is installed therein.

Figure 15:
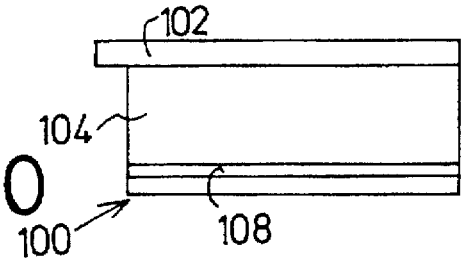
FIG. 15 is a side view of the cap illustrated in FIG. 14, showing in plan view the recess located in one of the legs.
Figure 14:
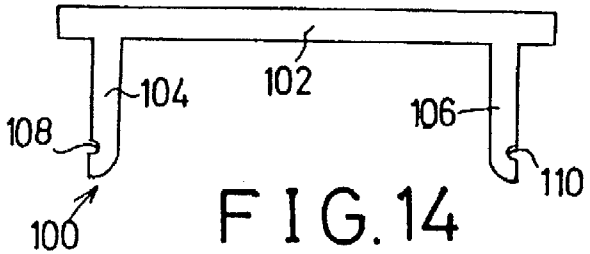
FIG. 14 is an end view of a cap which will enclose the top of the support member illustrated in FIGS. 12 and 13, showing two legs each having a recess for receiving one of the retaining bars of the support member illustrated in FIG. 12.
Figure 16:
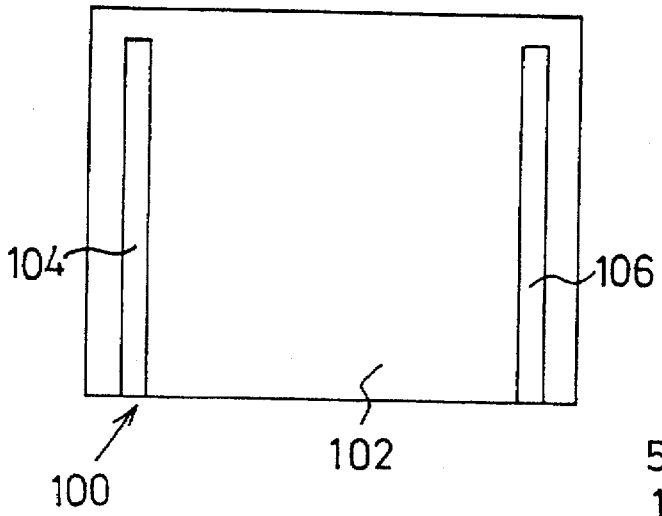
FIG. 16 is a bottom plan view of the cap illustrated in FIGS. 14 and 15, showing the configuration of the legs.

Referring next to FIGS. 14 through 16, a cap 100 which will be used to cover the support member 80 (shown in FIGS. 12 and 13) is illustrated. The cap 100 consists of a flat plate 102 having two downwardly projecting rectangular legs 104 and 106 extending therefrom. The flat plate 102 is of a size to exactly fit on top of the support member 80. The legs 104 and 106 are arranged and configured so as to fit closely inside the legs of the H-shaped segment 82. The leg 104 has a recess 108 located therein to receive the retaining bar 94 of the support member 80 (shown in FIG. 12) therein when the cap 100 is installed onto the support member 80. Similarly, the leg 106 has a recess 110 therein to receive the retaining bar 96 of the support member 80 therein when the cap 100 is installed onto the support member 80.

Figure 17:
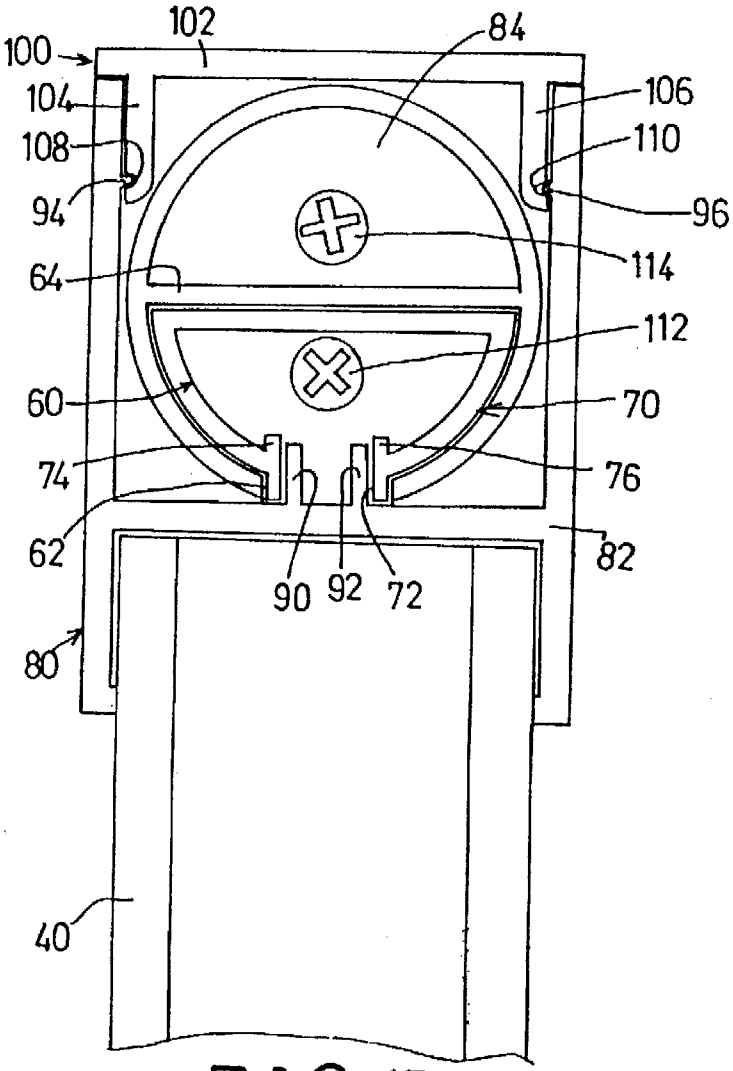
FIG. 17 is a plan view showing the placement of mounting screws within the support member illustrated in FIGS. 12 and 13, the metal track member illustrated in FIGS. 7 and 8 installed in the support member, the plastic rail illustrated in FIGS. 9 through 11 installed within the metal track member, and the cap illustrated in FIGS. 14 through 16 installed onto the support member.

Referring now to FIG. 17, the use of the support member 80 is illustrated in conjunction with the other components illustrated above. The support member 80 may be installed on a wall through the use of two screws 112 and 114, which are located in the mounting apertures 86 and 88, respectively. An end of the metal track member 60 is located in the H-shaped segment 82 of the support member 80 above the crossbar and between the portions of the legs of the H which are above the cross-bar of the H, flush against the plate segment 84.

The plastic rail 70 is located inside the metal track member 60 below the horizontal rib member 64, with the flat segments 74 and 76 of the plastic rail 70 extending down through the longitudinally extending slot 62 in the metal track member 60. The flat segments 90 and 92 of the support member 80 extend upwardly into the longitudinally extending slot 72 in the plastic rail 70, thereby keeping both the metal track member 60 and the plastic rail 70 properly oriented with their longitudinally extending slots 62 and 72, respectively, being oriented downwardly.

The cap 100 is shown located on top of the support member 80 with the legs 104 and 106 of the cap 100 being located inside the legs of the H-shaped segment 82. The recess 108 in the leg 104 is shown to be engaging the retaining bar 94 of the support member 80, and the recess 110 in the leg 106 is shown to be engaging the retaining bar 96 of the support member 80. The cap 100 is engaged with the support member 80 by sliding it into the H-shaped segment 82 until the legs 104 and 106 contact the plate segment 84 of the support member 80. Thus, the cap 100 is firmly retained on top of the support member 80, and will act to retain the metal track member 60 and the plastic rail 70 therein. The closure channel 40 may then be installed, with its top end being located between the portions of the legs of the H-shaped segment 82 located below the crossbar.

Figure 18:
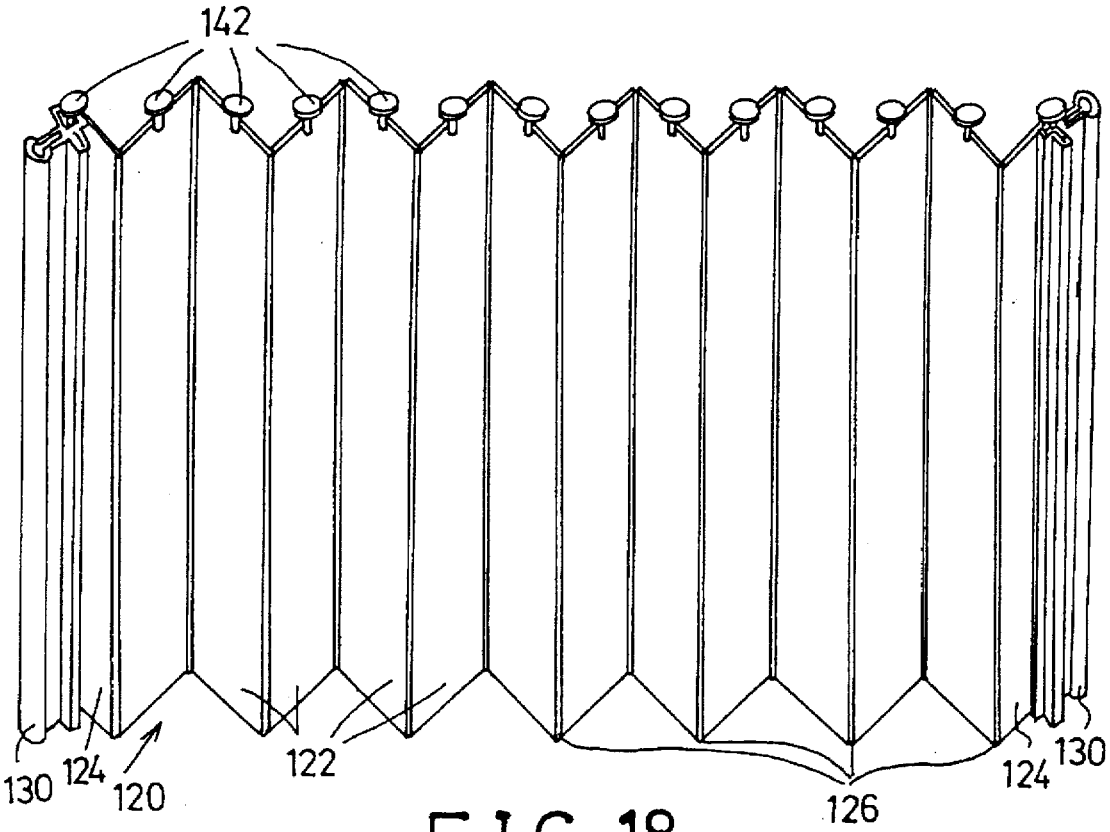
FIG. 18 is a perspective view of a shower door assembly made from a plurality of rigid rectangular panels hingedly connected together by a plurality of a live hinges, with a leader channel member being attached at each side of said shower door assembly, said leader channel members for being removably received in an interference fit in said longitudinal slot in said closure channels illustrated in FIGS. 1 through 3, and also showing a plurality of pieces of mounting hardware attached along the top end of said shower door assembly.

Referring next to FIG. 18, a shower door 120 constructed according to the teachings of the present invention is illustrated. The shower door 120 consists essentially of a plurality of semi-rigid or rigid panels which may be molded together of plastic material in a single molding operation, with living hinges being located intermediate each adjacent pair of semi-rigid panels. Alternately, the shower door 120 may be assembled of individual panels using flexibly living hinges which are adhesively or ultrasonically secured to the individual panels. In the preferred embodiment, the shower door 120 is made of transparent or translucent plastic material to allow light to enter the bath enclosure even when the shower door 120 is closed.

Aside from the panels used at each end of the shower door 120, a standard size-panel 122 is used throughout the width of the shower door 120. Narrower end panels 124 are used at the left and right sides of the shower door 120 as viewed in FIG. 18. As mentioned above, a living hinge 126 is either molded or adhesively or ultrasonically secured between each adjacent pair of the panels 122, as well as between the right-most and left-most panels 122 and the end panels 124. The construction of such a living hinge is well known in the art, and generally consists of a thinner portion of plastic material than the thickness of the panels 122 and the end panels 124 themselves.

Figure 19:
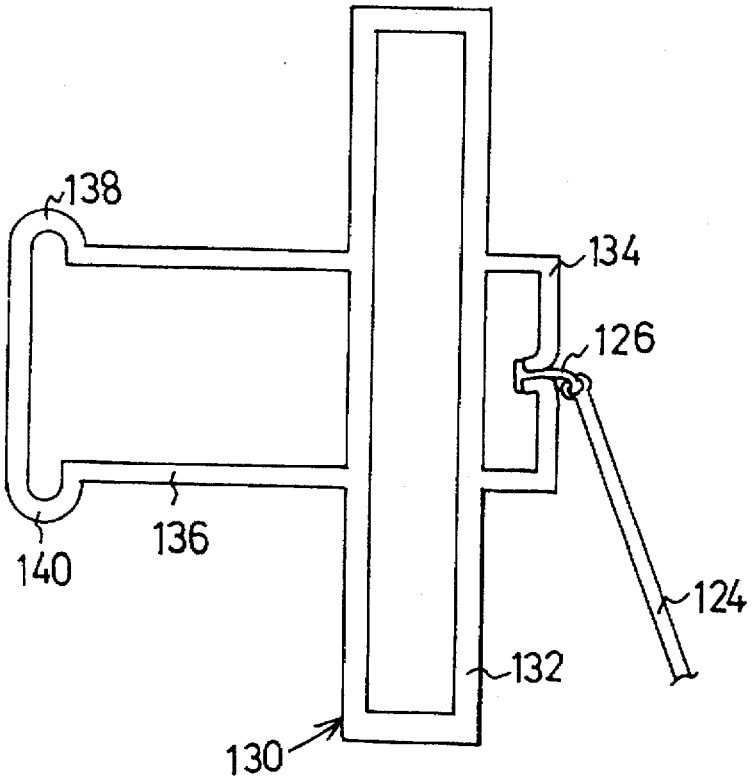
FIG. 19 is an end view of the leader channel member which is attached at the one side of a shower door assembly (illustrated in FIG. 18), showing the cross-sectional configuration of the leader channel member.

Located at each of the left and right sides of the shower door 120 as illustrated in FIG. 18 is a leader channel member 130, the cross sectional configuration of which is shown in FIG. 19. As will become evident below in conjunction with the discussion of FIG. 21, the leader channel members 130 will be used to affix the sides of the shower door 120 (shown in FIG. 26) to the closure channels 40 (shown in FIGS. 1 through 3), to thereby close the opening located above the outer lip of a bathtub (not shown in FIG. 18).

The moveable leader channel members 130 are preferably made of extruded plastic material. The cross sections of each of the leader channel member 130 is essentially t-shaped (like a small t as opposed to a capital T), with both a wide vertical member of the t and a wide horizontal member of the t. The horizontal member of the t consists of a hollow rectangular member 132, which is sufficiently wide to serve as a handle by which the leader channel member 130 may be manipulated.

The portion of the vertical member of the t above the horizontal member of the t (the hollow rectangular member 132) consists of a hollow rectangular member 134 with an opening therein to admit a portion of the living hinge 126 used to attach the end panel 124 therein. The end panel 124 is attached to the leader channel member 130 with the living hinge 126 at the opening at the top of the t, and it may be adhesively or ultrasonically secured, or, if desired, it may be molded together with the panels 122 and the end panels 124.

The bottom of the t of the leader channel member 130 consists essentially of a hollow rectangular member 136. The hollow rectangular member 136 has two semi-circular portions 138 and 140 extending from the sides thereof at the bottom of the t. Thus, the very bottom portion of the t is wider at the two semi-circular portions 138 and 140 than is the balance of the hollow rectangular member 136 below the horizontal member of the t. In addition, the two semi-circular portions 138 and 140 at the bottom of the t of the leader channel member 130 provide a rounded configuration, which is sized to fit in an interference fit into the longitudinal slot defined between the hollow legs 46 and 48 of the closure channel 40 (FIG. 3).

Returning to FIG. 18, the construction of the shower door 120 is completed by a plurality of pieces of mounting hardware 142, which are used to hang the shower door 120 from the horizontal track consisting of the metal track member 60 (FIGS. 7 and 8) and the plastic rail 70 (FIGS. 9 through 11). The mounting hardware 142 is used to slideably support each of the panels 122, and each of the leader channel members 130. The mounting hardware 142 is well known in the art, and may be either simple (as shown in FIG. 18, with discs (which will be installed inside the plastic rail 70) located at the distal ends of short rods, the proximal ends of which are attached to the shower door 120), or more elaborate (roller assemblies, not shown). The simple mounting hardware 142 illustrated in FIG. 18 may even be molded together with the shower door 120, if desired.

Figure 20:
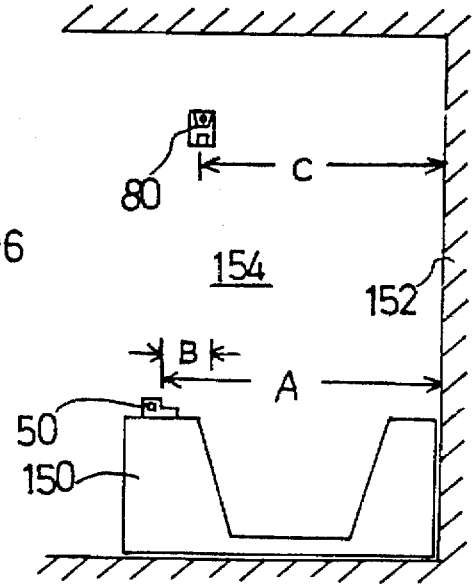
FIG. 20 is a somewhat schematic end view of a bathtub located in a recessed area, with the bathtub trim member illustrated in FIGS. 4 through 6 installed on top of the outer lip of the bathtub, showing the relative dimensions which identify the location of one of the support members for the horizontal tracks.

Turning now to FIG. 20, the first part of the installation of the shower door 120 of the present invention is illustrated. A bathtub 150 is located adjacent an inner wall 152, a left side wall 154, and a right side wall 156 (not shown in FIG. 20). The bathtub trim member 50 (FIGS. 3 through 6) is installed using silicone adhesive onto the top of the outer lip of the bathtub 150, with the flat strip 56 (FIG. 6) of the bathtub trim member 60 facing the inner wall 152, and the hollow square segment 54 (FIG. 6) of the bathtub trim member 50 facing the outside of the bathtub 150.

When the bathtub trim member 50 has been so installed, the distance A from the inner wall 152 to the side of the hollow square segment 54 (FIG. 6) facing the inner wall 152 must be measured. The distance B, which is approximately two inches, is then subtracted from the distance A, yielding a distance C. This distance C is the distance from the inner wall 152 to the centerline of the apparatus used to suspend the shower door 120 (FIG. 18), and it is marked on the left side wall 154 and on the right side wall 156 (not shown in FIG. 20). In FIG. 20, the support member 80 (FIGS. 12 and 13) is shown located in this manner.

Referring now to FIG. 21, the shower door 120 is shown installed using the horizontal track consisting of the metal track member 60 (FIGS. 7 and 8) and the plastic rail 70 (FIGS. 9 through 11), two of the support members 80 (FIGS. 12 and 13), and two of the caps 100 (FIGS. 14 through 16). A brief review of the installation using the horizontal track follows. First, the plastic rail 70 is inserted into the metal track member 60.

The mounting hardware 142 of the shower door 120 is inserted into the plastic rail 70 (which, in turn, is contained within the metal track member 60). The support members 80 are mounted in their proper positions on the left side wall 154 and the right side wall 156 using screws (not shown) which extend through the apertures 86 and 88 therein.

The ends of the horizontal track consisting of the metal track member 60 (FIGS. 7 and 8) and the plastic rail 70 (FIGS. 9 through 11) are dropped into their positions (described above in conjunction with FIG. 17) in the support members 80. The caps 100 are slid into place on the support members 80 to retain the horizontal track therein. Finally, the closure channels 40 are secured to the left side wall 154 and the right side wall 156 using silicone adhesive.

To close the shower curtain 120, the leader channel member 130 at the left end of the shower door 120 is inserted into the closure channel 40 on the left wall 154, and the leader channel member 130 at the right end of the shower door 120 is inserted into the closure channel 40 on the right side wall 156. Thus, it will be appreciated that entrance to or egress from the bathtub 150 may be from either side of the shower curtain 120. The shower door 120 will slide smoothly on the plastic rail 70 in the horizontal track. Additionally, the transparent or translucent shower door 120 will allow light into the enclosure, rather than blocking light like previously known shower curtains.

It may therefore be appreciated from the above detailed description of the preferred embodiment of the present invention that it teaches an improved shower door assembly which combines the best features of both shower curtains and sliding glass doors, while not presenting any of the relative disadvantages of either shower curtains or sliding glass doors. As such, the improved shower door assembly of the present invention presents the operational advantage of sliding glass doors in that it is relatively rigid when in use, forming a fixed water-containing enclosure which is not subject to movement due to air flow caused by the warm or hot stream of shower water. The improved shower door assembly of the present invention also presents the advantageous sealing aspect of sliding glass doors at both ends thereof, and in fact further enhances this sealing aspect through the use of a positive closing mechanism on both ends of the shower door.

The improved shower door assembly of the present invention slides smoothly and easily due to the improved design of the track member, and it is relatively quiet as it is opened or closed. The improved shower door assembly of the present invention is storable in a compact and unobtrusive folded package when not in use, and thus presents an aesthetically pleasing appearance when so stored. In addition, the improved shower door of the present invention is both easy and convenient to open and close, and in one embodiment may even be opened at either end thereof. Further, the improved shower door of the present invention is relatively easy to install, and its installation does not require specialized tools or a high degree of mechanical ability.

The improved shower door of the present invention is of a construction which is durable, long lasting, and easy to keep clean, and it requires no maintenance from the user during its operating lifetime. The improved shower door of the present invention is also of inexpensive construction as compared to a sliding glass door, thereby enhancing its market appeal and affording it the broadest possible market. Finally, all of the aforesaid advantages and objectives of the improved shower door of the present invention are achieved without incurring any substantial relative disadvantage.

Although an exemplary embodiment of the present invention has been shown and described with reference to particular embodiments and applications thereof, it will be apparent to those having ordinary skill in the art that a number of changes, modifications, or alterations to the invention as described herein may be made, none of which depart from the spirit or scope of the present invention. All such changes, modifications, and alterations should therefore be seen as being within the scope of the present invention.

What is claimed is:

1. A shower door assembly for use with a bathtub recessed between opposing side walls at first and second ends thereof, said shower door assembly comprising:

a hollow track support member having a longitudinally extending slot located therein, said track support member including a tubular segment having a longitudinally extending slot located therein, said tubular segment being mounted with said longitudinally extending slot oriented downwardly, said track support member including a thin, horizontal rib member located inside said track support member, said horizontal rib member being located at a diameter of said track support member, said horizontal rib member functioning to reinforce said track support member, a hollow track rail for installation inside said track support member, said track rail also having a longitudinally extending slot located therein which is aligned with said longitudinally extending slot in said track support member, said track rail including a hollow segment which is semi-circular in cross section and has a flat top side fitting immediately below said horizontal rib member in said track support member, said semi-circular segment including a longitudinally extending slot located in the bottom thereof with thin, flat segments each extending both slightly below and slightly above said semi-circular segment, said flat segments being parallel to each other and orthogonally oriented with respect to said flat top side of said semi-circular segment, said flat segments extending sufficiently below said semi-circular segment to fill said longitudinally extending slot in said track support member, means for mounting said hollow track support member horizontally above an outer lip of the bathtub and between the opposing side walls at the first and second ends of the bathtub, said mounting means including a pair of support members each having an H-shaped segment, said H-shaped segment having a plate segment extending above the cross-bar of the H and between the portions of the legs of the H which are above the cross-bar of the H, said plate segment having a spaced-apart pair of mounting apertures located therein midway between the legs of the H, said support members adapted to be mounted on the opposing side walls at the first and second ends of the bathtub, respectively, the ends of said track support member each being supported by one of said support members, said mounting means including positioning means extending upwardly from the crossbar of said H-shaped segment for insertion into said longitudinally extending slot of said track support member to orient said track support member with said longitudinally extending slot oriented downwardly, said mounting means including a cap for placement on each support member above the legs of the H which are above the cross-bar of said H-shaped segment to retain the ends of said track support member within said support members, said mounting means including interconnecting means located on said caps and on said support members to removably affix said caps in position on said support members, a shower door including a plurality of semi-rigid panels having a living hinge disposed intermediate each adjacent pair of semi-rigid panels, said shower door having a top edge and a bottom edge and a first side and a second side, said shower door including a first vertically disposed leader channel member attached to said first side of said shower door and a second vertically disposed leader channel member attached to said second side of said shower door, a first closure channel for permanent mounting on the side wall at the first end of the bathtub, said first leader channel member of said shower door being adapted to be removably engaged with said first closure channel in a watertight fashion, a second closure channel for permanent mounting on the side wall at the second end of the bathtub, said second leader channel member of said shower door being adapted to be removably engaged with said second closure channel in a watertight fashion, mounting hardware for slideable installation within said track rail to suspend said shower door in a manner whereby said shower door is capable of unfolding to enclose an area over the outer lip of the bathtub and between the side walls at the first and second ends of the bathtub, said mounting hardware sliding freely within said track rail in a manner allowing said shower door to fold to allow access to or egress from the bathtub, said mounting hardware including a plurality of discs each mounted orthogonally and coaxially onto a short support rod, said plurality of discs being located within and slidably supported by said track rail, each of said support rods being attached to a panel of said shower door to thereby support said shower door, and means for retaining the bottom edge of said shower door within an area bordered by the outer lip of the bathtub to prevent water from leaking between the bottom edge of said shower door and the outer lip of the bathtub, said retaining means including a bathtub trim member for installation on top of the outer lip of the bathtub, said bathtub trim member including a flat bar segment located edgewise adjacent the side of a square segment which is significantly higher than the flat bar segment, said square segment functioning to retain said bottom of said shower door within the area bordered by the outer lip of the bathtub, said flat bar segment functioning to channel water dripping from said shower door back into the bathtub.

* * * * *